US009822522B2

(12) United States Patent
Cruey

(10) Patent No.: US 9,822,522 B2
(45) Date of Patent: Nov. 21, 2017

(54) ARCHED CABIN

(71) Applicant: David Wayne Cruey, Cypress, TX (US)

(72) Inventor: David Wayne Cruey, Cypress, TX (US)

( * ) Notice: Subject to any disclaimer, the term of this patent is extended or adjusted under 35 U.S.C. 154(b) by 0 days.

(21) Appl. No.: 15/400,642

(22) Filed: Jan. 6, 2017

(65) Prior Publication Data

US 2017/0191252 A1 Jul. 6, 2017

Related U.S. Application Data

(63) Continuation-in-part of application No. 29/554,580, filed on Feb. 12, 2016, now Pat. No. Des. 792,983.

(60) Provisional application No. 62/275,568, filed on Jan. 6, 2016.

(51) Int. Cl.

| | |
|---|---|
| ***E04B 1/32*** | (2006.01) |
| ***E04B 7/08*** | (2006.01) |
| ***E04D 3/24*** | (2006.01) |
| ***E04D 13/16*** | (2006.01) |
| ***E04D 3/02*** | (2006.01) |
| ***E04H 1/00*** | (2006.01) |

(52) U.S. Cl.

CPC ..... *E04B 1/3205* (2013.01); *E04B 7/08* (2013.01); *E04D 3/02* (2013.01); *E04D 3/24* (2013.01); *E04D 13/1606* (2013.01); *E04H 1/00* (2013.01); *E04B 2001/327* (2013.01)

(58) Field of Classification Search

CPC ..... E04D 3/24; E04D 13/0352; E04D 3/02; E04D 13/1606; E04B 1/3205; E04B 1/185; E04B 7/08; E04B 2001/0061; E04H 1/00

See application file for complete search history.

(56) References Cited

U.S. PATENT DOCUMENTS 1,687,850 A * 10/1928 Shodron ..... E04B 7/08 52/644
1,762,363 A * 6/1930 Sergent ..... A01K 31/22 52/642
2,801,716 A * 8/1957 Colby, Jr. ..... E04B 1/3205 52/274

(Continued)

FOREIGN PATENT DOCUMENTS

DE 858016 C * 12/1952 ..... E04B 7/08
DE 2402171 A1 * 7/1975 ..... E04B 1/185

(Continued)

*Primary Examiner* — Babajide Demuren

(57) ABSTRACT

An alternative design for a cabin or a house which utilizes an arched shape to provide a significantly stronger overall structure. The design includes a first roofing structure, a second roofing structure, a planar base, and a ridge beam. The planar base makes up the flooring for the cabin. The ridge beam is positioned parallel to and offset to the planar base to join and support the first roofing structure and the second roofing structure. The first roofing structure and the second roofing structure are positioned opposite to each other across the bridge beam and each includes a plurality of arched beams and a plurality of roofing boards. The arched beams are distributed along the bridge beam and are connected in between the bridge beam and the planar base. The roofing boards are distributed across and mounted to the arched beams to make up the roof of the cabin.

13 Claims, 10 Drawing Sheets

(56) References Cited

U.S. PATENT DOCUMENTS 3,057,119 A * 10/1962 Kessler ..... E04B 1/3205 29/449
3,780,477 A * 12/1973 Sprung, Jr. ..... E04B 1/32 135/119
3,968,604 A * 7/1976 Hills ..... E04B 1/3205 52/745.07
3,996,704 A * 12/1976 Huey ..... E04H 6/005 52/206
4,091,584 A * 5/1978 Brown ..... A01G 9/16 135/127
4,377,314 A * 3/1983 Gevers ..... A47B 47/00 108/59
4,501,103 A * 2/1985 Markey ..... E04B 1/2612 52/127.2
4,841,688 A * 6/1989 Rinaldi ..... E04H 15/322 52/63
4,885,879 A * 12/1989 Plantier ..... E01F 7/02 52/299
4,987,707 A * 1/1991 Kiselev ..... E04B 1/3211 52/82
5,233,799 A * 8/1993 Abukawa ..... B21D 5/08 52/53
5,385,423 A * 1/1995 Abukawa ..... B21D 5/08 403/186
5,540,014 A * 7/1996 Smith ..... E04C 2/54 135/118
5,595,203 A * 1/1997 Espinosa ..... E04H 15/36 135/123
5,598,668 A * 2/1997 Isom ..... A01G 9/16 135/118
5,611,178 A * 3/1997 Aubert ..... E04H 9/12 109/1 S
6,161,342 A * 12/2000 Barbier ..... E02D 29/05 405/124
6,205,605 B1 * 3/2001 Orsat ..... E01D 21/00 14/24
6,434,891 B1 * 8/2002 Cameron ..... E04B 1/3205 52/86
6,594,957 B1 * 7/2003 Milburn ..... A01G 9/1415 47/17
6,647,679 B2 * 11/2003 Belleau ..... E04F 13/06 52/254
6,679,009 B2 * 1/2004 Hotes ..... E04H 15/36 135/117
6,952,900 B2 * 10/2005 Leurent ..... E04H 3/165 52/80.1
8,307,605 B2 * 11/2012 McCarty ..... E04B 7/08 52/745.07
2010/0058689 A1 * 3/2010 Campbell ..... E02D 27/02 52/270
2013/0227896 A1 * 9/2013 Anderson ..... B21D 5/08 52/86
2013/0263529 A1 * 10/2013 Wilson ..... E01F 5/005 52/86
2014/0290153 A1 * 10/2014 Christensen ..... E04B 1/3205 52/86
2015/0000216 A1 * 1/2015 Noble ..... E04B 1/3205 52/80.1

FOREIGN PATENT DOCUMENTS

FR 922320 A * 6/1947 ..... E04B 1/3205
FR 992345 A * 10/1951 ..... E04B 1/3205
GB 118442 A * 8/1918 ..... E04B 1/3205
GB 604932 A * 7/1948 ..... E04B 1/3205
GB 882773 A * 11/1961 ..... E04B 1/3205
WO WO 9801635 A1 * 1/1998 ..... E04B 7/08
WO WO 2006081214 A2 * 8/2006 ..... E02D 29/05

* cited by examiner

SECTION A-A

ARCHED CABIN

The current application claims a priority to the U.S. Provisional Patent application Ser. No. 62/275,568 filed on Jan. 6, 2016.

FIELD OF THE INVENTION

The present invention relates generally to housing structures. More specifically, the present invention is an arched cabin or house that utilizes unique components and arrangement of components to provide an improved structure and convenient assembly process. In this regard, the structural strength of the present invention will be greater than that of similar conventional cabin and house structures.

BACKGROUND OF THE INVENTION

The present invention is an arched cabin or house comprising uniquely rolled arched support beams and connecting components to provide a strong, cost-effective and more conveniently erectable structure. Currently, there are a variety of different ways in which structural frames can be assembled and constructed. Most conventional housing structures utilize a similar framework consisting of straight beams and supports which are generally welded together or held together via fasteners. Straight beam structures are generally weaker than arched structures due to the differences in the load distribution, therefore the curved structural framework of the present invention provides a more robust structural assembly. Although similar arched buildings exist today, none of the inventions utilize the uniquely rolled arched support beams and component configuration that is an integral part of the present invention.

In addition to providing a robust and cost-effective structure, the present invention provides a structural assembly that is much more convenient to assemble and erect than conventional cabins and houses. For example, due to the way in which the arched support beams are connected there will be no need for an extensive amount of welding, which saves time and energy as welding is a time consuming and highly specialized process. Additionally, the way in which the components are fastened to the structural frame will add to the structural integrity of the present invention. For example, the insulation and roofing panels are oriented horizontally along the vertically aligned arched support beams to prevent the frame from racking. In this regard, the present invention provides various ways in which improves upon the structural strength and integrity of the cabin assembly while keeping costs down. Therefore, the present invention is an arched cabin or house that improves upon similar existing inventions.

DETAIL DESCRIPTIONS OF THE INVENTION

All illustrations of the drawings are for the purpose of describing selected versions of the present invention and are not intended to limit the scope of the present invention.

An arched cabin is described herein. The arched cabin provides an efficient, cost effective, durable, attractive and easy-to-build structure with a variety of different uses. Such uses include, but are not limited to workshops, animal shelters, vacation homes, RV shelters, retirement homes and hunting lodges. The curved design of the arched cabin is provides a strong, cheaper alternative housing structure having various uses. The arched cabin can be erected within a matter of days and has numerous options with regards to its customizability. The options include, but are not limited to the type of insulation, color of roofing panels, addition of floor joists for a multi-level arched cabin, the addition of a fireplace, the addition of end caps comprising doors and windows in any configuration, and much more. Therefore, the present invention provides a unique arched cabin assembly that is fully customizable, durable and easily erectable.

Figure 1:
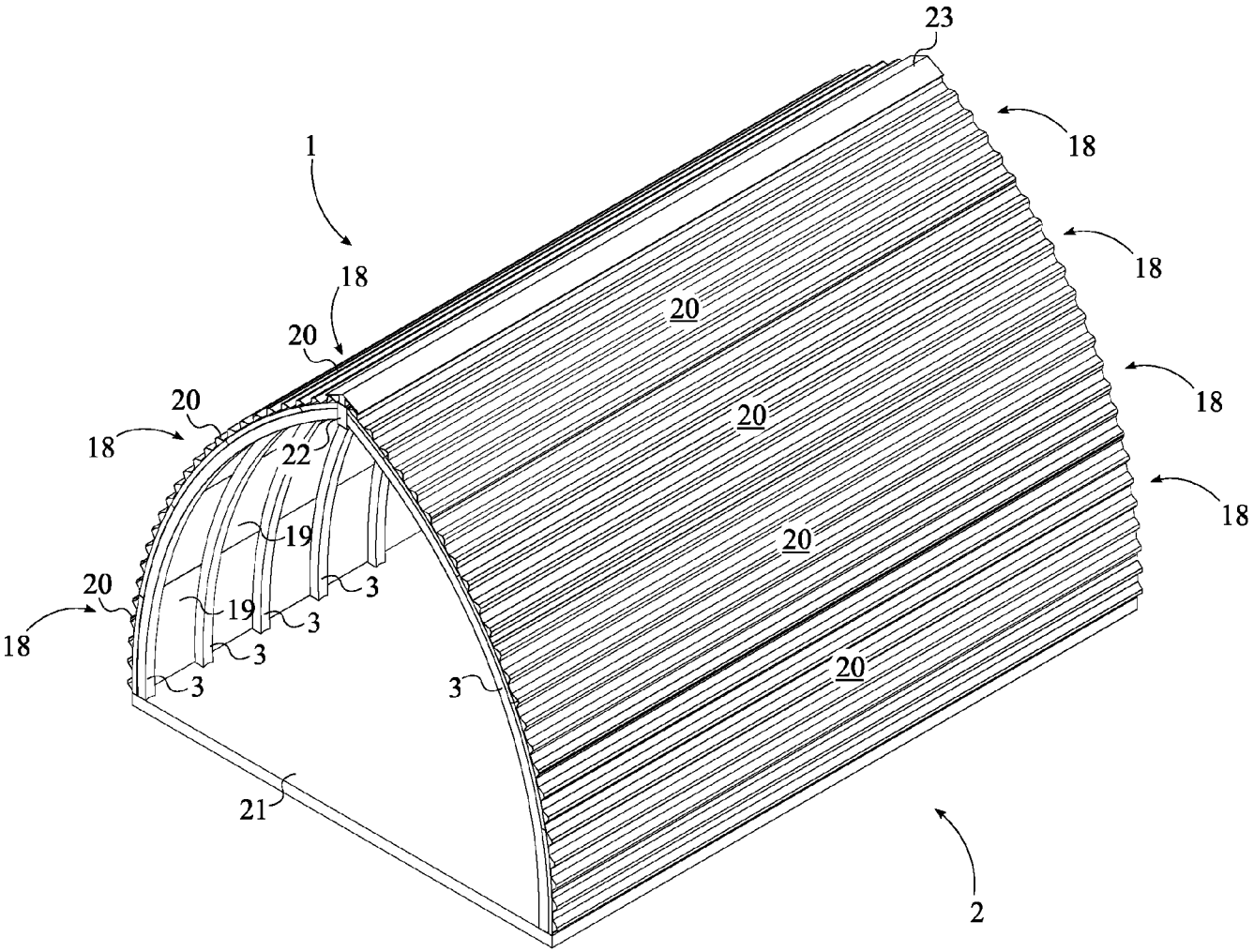
FIG. 1 is a perspective view of the present invention.

Referring to FIG. 1, the present invention comprises a planar base 21, a ridge beam 22, a first roofing structure 1, a second roofing structure 2, and an elongated ridge cap 23. The planar base 21 is a structural plate which serves as the base flooring and anchor for the present invention. The ridge beam 22 is a structural member which connects and supports the first roofing structure 1 and the second roofing structure 2. Additionally, the ridge beam 22 is an elongated rectangular beam which spans the length of the planar base 21. The ridge beam 22 is positioned parallel to and offset from the planar base 21. The first roofing structure 1 and the second roofing structure 2 make up the supporting frame and the roof for the present invention. More specifically, the first roofing structure 1 and the second roofing structure 2 each comprise a plurality of arched beams 3 and a plurality of roofing boards 18. The first roofing structure 1 is positioned adjacent to the ridge beam 22. Similarly, the second roofing structure 2 is positioned adjacent to the ridge beam 22, opposite to the first roofing structure 1. The first roofing structure 1 and the second roofing structure 2 mirror each other across a sagittal plane of the present invention. This yields a symmetric structural integrity throughout the present invention.

Figure 2:
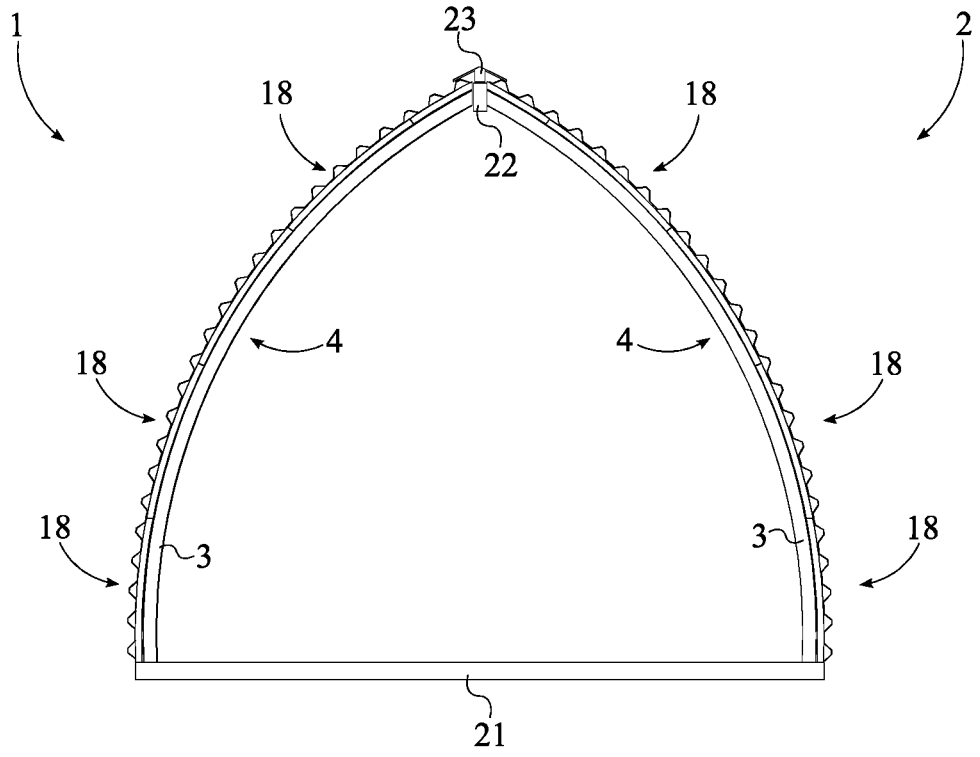
FIG. 2 is a front view of the present invention.
Figure 3:
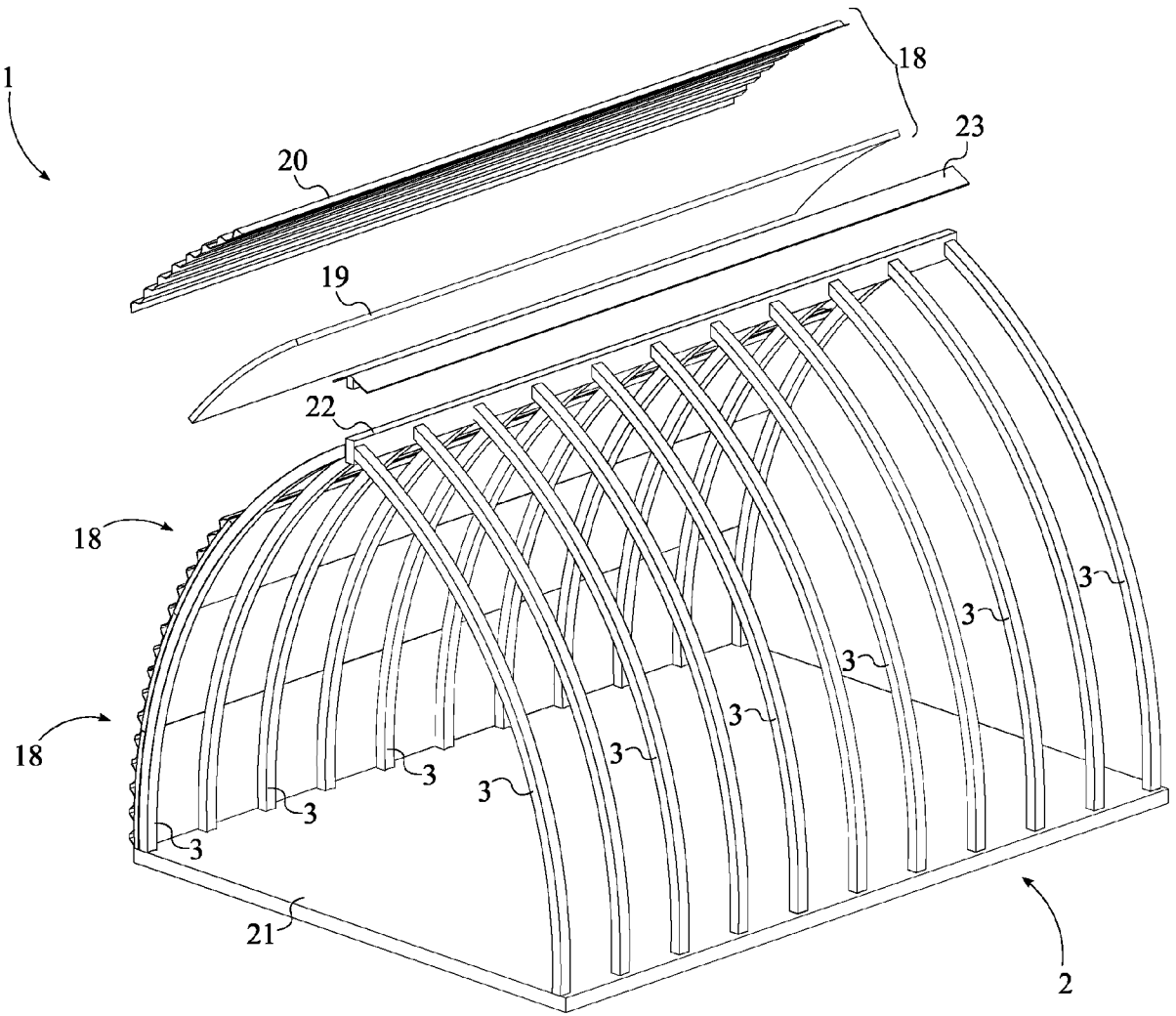
FIG. 3 is a partially exploded perspective view of the present invention, depicting plurality of roofing boards.

Referring to FIG. 2 and FIG. 3, each of the plurality of arched beams 3 is an elongated structural beam that is bent into an arc shape. The plurality of arched beams 3 is distributed, preferably equally, along the ridge beam 22 with each of the plurality of arched beams 3 being connected in between the ridge beam 22 and the planar base 21. Thus, the plurality of arched beams 3 from the first roofing structure 1 and the second roofing structure 2 make up the framing for the present invention and allow for the plurality of roofing boards 18 to be mounted. Each of the plurality of arched beams 3 is constructed through a rolling process and includes a concave portion 4. The concave portion 4 for each of the plurality of arched beams 3 is oriented towards the planar base 21. The rolling process yields a design that is over twice the strength of conventional arched support members, therefore increasing the overall structural integrity and strength of the present invention.

The plurality of roofing boards 18 provides protection to the habitants within the present invention from the external environment. Referring to FIG. 3, the plurality of roofing boards 18 is distributed across the plurality of arched beams 3, opposite the planar base 21. Each of the plurality of roofing boards 18 is mounted to an at least two corresponding proximal beams from the plurality of arched beams 3. Each of the plurality of roofing boards 18 is preferably an elongated panel shape that is oriented parallel to the ridge beam 22 and stacked in sequence along the length of each of the plurality of arched beams 3. This prevents racking failure and increases the structural stability of the present invention. In the preferred embodiment of the present invention, each of the plurality roofing boards 18 is manufactured to compliment the curved shape of each of the plurality of arched beams 3. In another embodiment of the present invention, each of the plurality of roofing boards 18 is composed of a flexible material in order to conform to the curved shape of each of the plurality of arched beams 3.

Referring to FIG. 3, each of the plurality of roofing boards 18 comprises a heat-insulating panel 19 and a weather-proof panel 20. The weather-proof panel 20 physically protects the plurality of arched beams 3, the planar base 21, and other internal components of the present invention from external forces and external weather conditions. The weather-proof panel 20 is preferably an elongated panel that is oriented parallel to the ridge bridge and extends along the plurality of arched beams 3. The weather-proof panel 20 for each of the plurality of roofing boards 18 is mounted to the at least two corresponding proximal beams. A variety of roofing material and roofing designs may be used for the weather-proof panel 20 components. The heat-insulating panel 19 prevents the loss of heat from the interior space of the present invention. The heat-insulating panel 19 is shaped and sized similar to the weather-proof panel 20 and is connected in between the at least two corresponding proximal beams and the weather-proof panel 20. In one embodiment, the heat-insulating panel 19 is connected to the at least two corresponding proximal beams directly through self-drilling screws. In another embodiment of the present invention, the heat-insulating panel 19 is secured by the fasteners used to secure the weather-proof panel 20.

Figure 10:
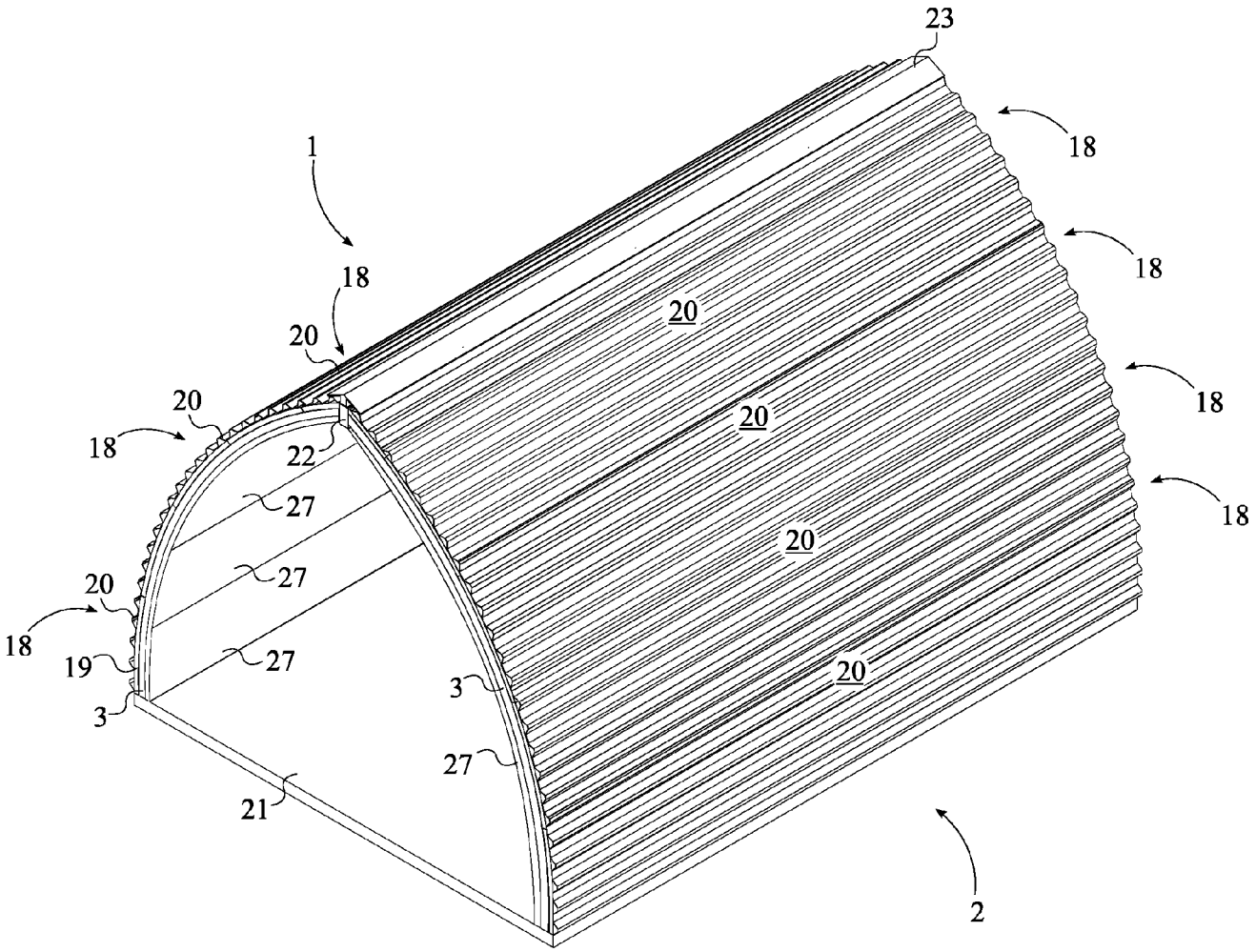
FIG. 10 is a front perspective view of the present invention, depicting the plurality of internal heat-insulating panels.

Referring to FIG. 10, in an alternative embodiment of the present invention, the first roofing structure 1 and the second roofing structure 2 each further comprise a plurality of internal heat-insulating panels 27. The plurality of internal heat-insulating panels 27 provides an additional insulating layer to the present invention. Similar to each of the plurality of roofing boards 18, each of the plurality of internal heat-insulating panels 27 is an elongated curved panel which spans the length of the ridge beam 22. The plurality of internal heat-insulating panels 27 is distributed adjacent and across the plurality of arched beams 3, opposite the plurality of roofing boards 18. Additionally, each of the plurality of internal heat-insulating panels 27 is mounted to the at least two corresponding proximal beams from the plurality of arched beams 3.

The elongated ridge cap 23 prevents water, snow, and other debris from leaking/falling into the interior space of the present invention. The elongated ridge cap 23 is positioned parallel and adjacent to the ridge beam 22, i.e. at the apex of the structure in between the first roofing structure 1 and the second roofing structure 2. The elongated ridge cap 23 is mounted along the ridge beam 22, opposite the planar base 21. Additionally, the elongated ridge cap 23 partially and laterally extends over the first roofing structure 1 and the second roofing structure 2. Any standard ridge cap design may be used for the elongated ridge cap 23, therefore the present invention is not limited to any specific ridge cap.

Figure 8:
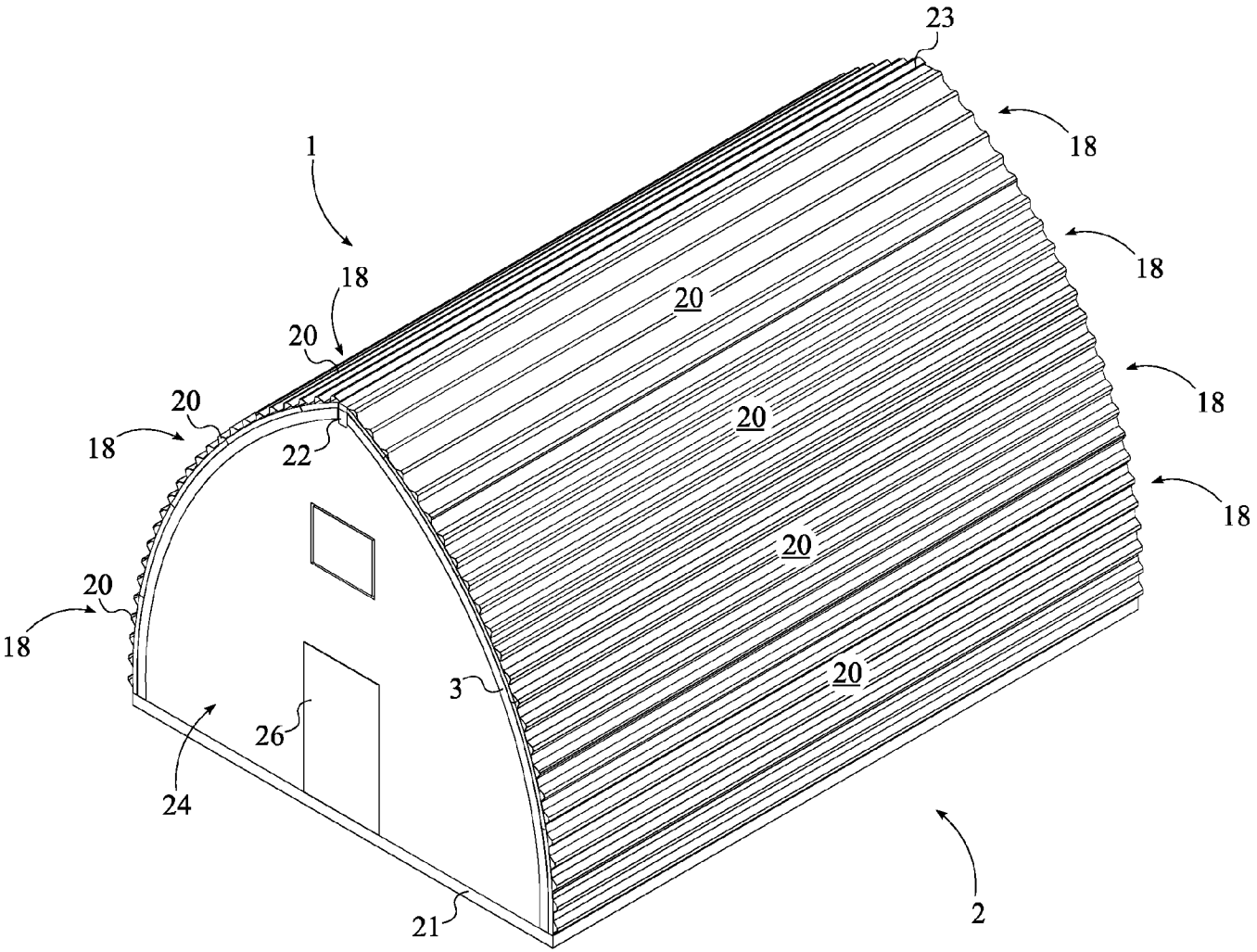
FIG. 8 is a front perspective view of the present invention, depicting the front sidewall.
Figure 9:
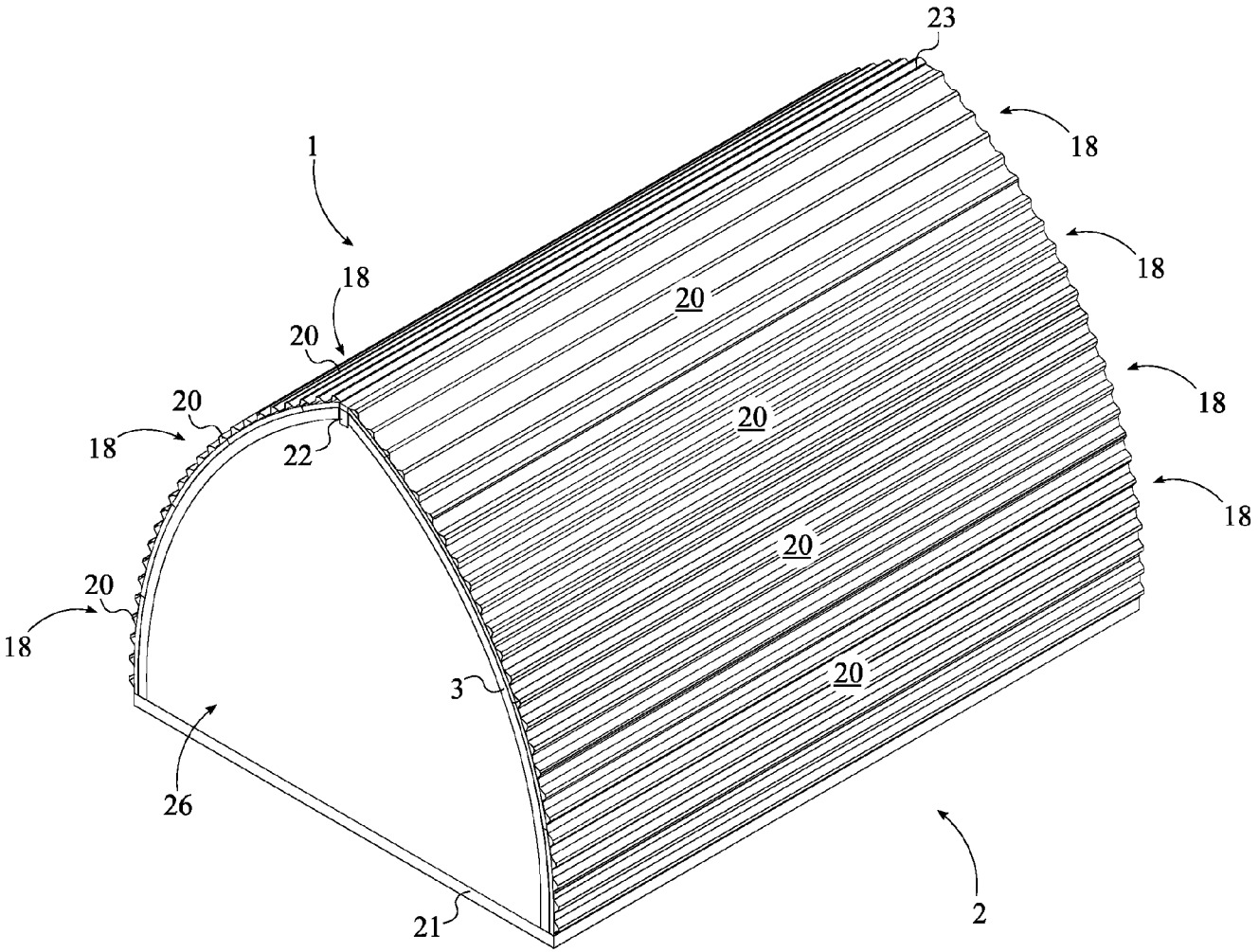
FIG. 9 is a rear perspective view of the present invention, depicting the rear sidewall.

Referring to FIG. 8 and FIG. 9, it is understood that various accessories may be added to facilitate in the overall appearance and function of the present invention. For example, in one embodiment, the present invention further comprises a front sidewall 24, a rear sidewall 25, and a building entrance 26. The front sidewall 24 closes off a front region of the present invention. In particular, the front sidewall 24 is positioned adjacent and perpendicular to the planar base 21 and is perimetrically connected to the planar base 21, the first roofing structure 1, and the second roofing structure 2. The rear sidewall 25 closes off a rear region of the present invention. In particular, the rear sidewall 25 is positioned parallel and opposite the front sidewall 24, across the planar base 21 and is perimetrically connected to the planar base 21, the first roofing structure 1, and the second roofing structure 2. The building entrance 26 allows the user to enter and leave the present invention and is mechanically integrated into the front sidewall 24. Additional feature that may be implemented with the present invention include, but are not limited to, windows, additional doors, and other similar building structures.

Figure 4:
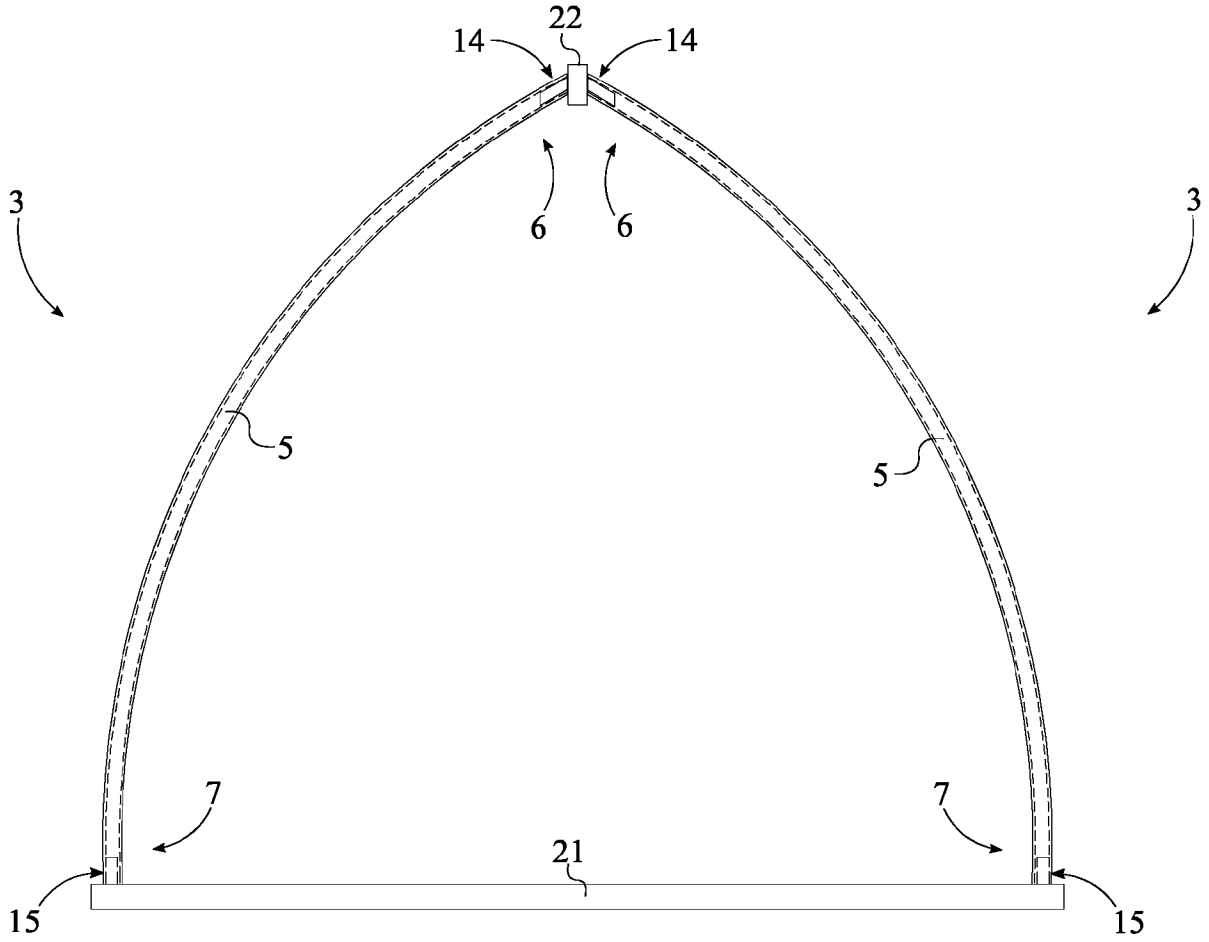
FIG. 4 is an internal front view of the present invention without the plurality of roofing boards and the elongated ridge cap.
Figure 5:
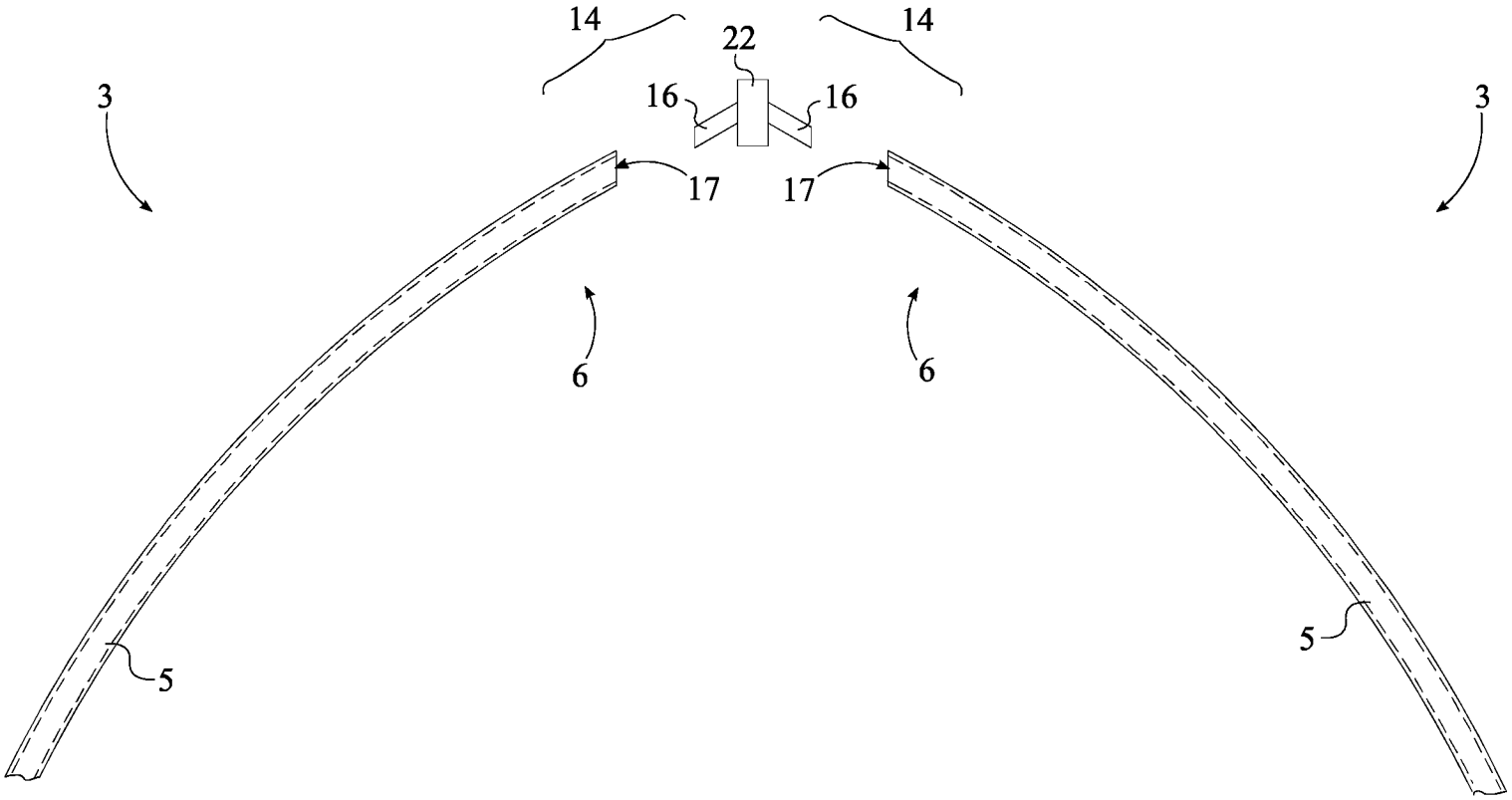
FIG. 5 is an exploded and enlarged view of the present invention as seen in FIG. 4, depicting the apex fastener.
Figure 6:
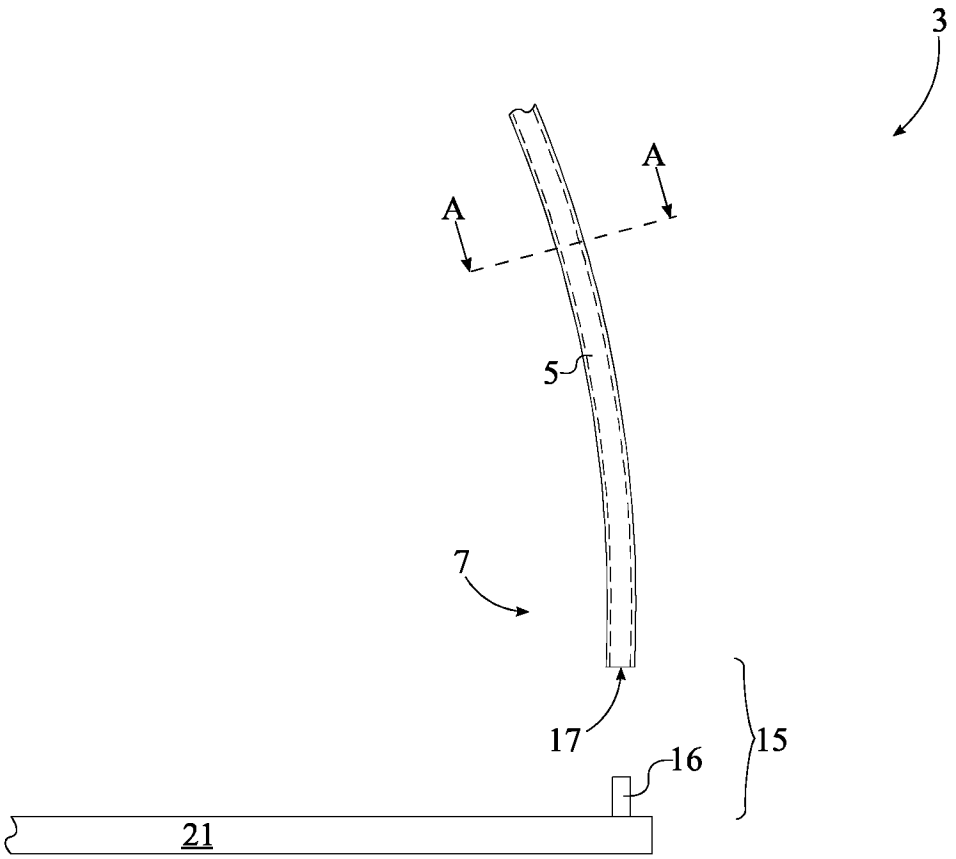
FIG. 6 is an exploded and enlarged view of the present invention as seen in FIG. 4, depicting the base fastener.
Figure 7:
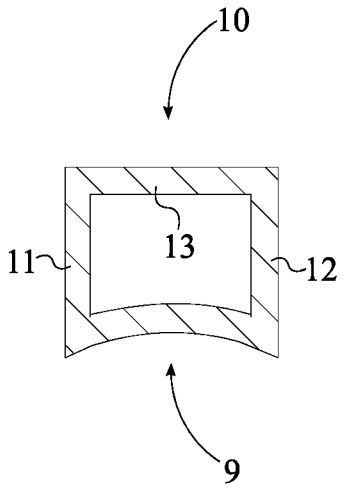
FIG. 7 is a cross-sectional view of one of the plurality of arched beams taken about like A-A in FIG. 6.

Referring to FIGS. 4-6, one of the main features of the present invention is the shape, design, and form of the plurality of arched beams 3 as well as the type of fasteners used to secure the plurality of arched beams 3 to the ridge beam 22 and the planar base 21. In particular, each of the plurality of arched beams 3 comprises a tubular beam body 5, an apex fastener 14, and a base fastener 15. The tubular beam body 5 is constructed through a rolling processes to yield a significantly high strength when compared to conventional designs. Additionally, the tubular beam body 5 retains air within an interior space of the tubular beam body 5, thus providing additional heat insulation to the overall structure of the present invention. Furthermore, referring to FIG. 7, a cross-section 8 of the tubular beam body 5 comprises a U-shaped portion 10 and a convex portion 9. The convex portion 9 is connected in between a first leg 11 of the U-shaped portion 10 and a second leg 12 of the U-shaped portion 10. Additionally, the convex portion 9 is oriented towards an interconnecting leg 13 of the U-shaped portion 10. The tubular beam body 5 is oriented with the convex portion 9 adjacent to the planar base 21. In other embodiments of the present invention, the cross-section 8 of the tubular beam body 5 may vary to meet the needs and preferences of the user. Type of designs and shapes that may be used for the cross-section 8 of the tubular beam body 5 include, but, are not limited to rectangular shaped, square shaped, circular shaped, and other similar designs. In alternative embodiments of the present invention, each of the arched beams 3 comprises a solid beam.

The apex fastener 14 secures the tubular beam body 5 to the ridge beam 22. More specifically, a first end 6 of the tubular beam body 5 is laterally fixed to the ridge beam 22 by the apex fastener 14. The base fastener 15 secures the tubular beam body 5 to the planar base 21. More specifically, a second end 7 of the tubular beam body 5 is peripherally fixed to the planar base 21 by the base fastener 15. A variety of fasteners may be used as the apex fastener 14 and the base fastener 15. In the preferred embodiment of the present invention, the apex fastener 14 and the base fastener 15 each comprise a male portion 16 and a female portion 17. The male portion 16 is a stub and the female portion 17 is a stub-receiving cavity. This allows for a slip-fit junction. The male portion 16 of the apex fastener 14 is connected, welded preferably, adjacent to the ridge beam 22. The female portion 17 of the apex fastener 14 is mechanically integrated into the first end 6 of the tubular beam body 5. When connected, the male portion 16 of the apex fastener 14 is mechanically engaged into the female portion 17 of the apex fastener 14. The male portion 16 of the base fastener 15 is connected adjacent and normal to the planar base 21. The female portion 17 of the base fastener 15 is mechanically integrated into the second end 7 of the tubular beam body 5. When connected, the male portion 16 of the base fastener 15 is mechanically engaged into the female portion 17 of the base fastener 15. A variety of means may be used to mechanically engage the male portion 16 within the female portion 17 including, but not limited to, screws, bolts, pins, welding, and other securing means. The slip-fit connection of the apex fastener 14 and the base fastener 15 allow for builders to raise the plurality of arched beams 3 of the first roofing structure 1 and the second roofing structure 2 with the ridge beam 22 quickly and efficiently.

It is understood that various accessories may be added to the present invention to facilitate in the overall appearance and function. For example, angled clips may be fastened to the plurality of arched beams 3 such that a loft floor joist can be included to provide a multi-level arched cabin. In this regard, loft support walls will need to be added to provide support for the loft floor joist.

Although the invention has been explained in relation to its preferred embodiment, it is to be understood that many other possible modifications and variations can be made without departing from the spirit and scope of the invention as hereinafter claimed.

What is claimed is:

1. An improved arched cabin comprising:

a first roofing structure;

a second roofing structure;

a planar base;

a ridge beam;

the first roofing structure and the second roofing structure each comprising a plurality of arched beams and a plurality of roofing boards;

the ridge beam being positioned parallel to the planar base;

the ridge beam being positioned offset from the planar base;

the first roofing structure being positioned adjacent to the ridge beam;

the second roofing structure being positioned adjacent to the ridge beam, opposite to the first roofing structure;

the plurality of arched beams being distributed along the ridge beam;

each of the plurality of arched beams being connected in between the ridge beam and the planar base;

a concave portion for each of the plurality of arched beams being oriented towards the planar base;

the plurality of roofing boards being distributed across the plurality of arched beams, opposite the planar base;

each of the plurality of roofing boards being mounted to an at least two corresponding proximal beams from the plurality of arched beams;

each of the plurality of arched beams comprising a tubular beam body, an apex fastener, and a base fastener;

a first end of the tubular beam body being laterally fixed the ridge beam by the apex fastener;

a second end of the tubular beam body being peripherally fixed to the planar base by the base fastener;

a cross-section of the tubular beam body comprising a U-shaped portion and an arched portion;

the arched portion being connected in between a first leg of the U-shaped portion and a second leg of the U-shaped portion;

the arched portion comprising a convex surface and a concave surface;

the convex surface being oriented towards an interconnecting leg of the U-shaped portion; and the concave surface being oriented towards the planar base.

2. The improved arched cabin as claimed in claim 1 comprising:

an elongated ridge cap;

the elongated ridge cap being positioned parallel and adjacent to the ridge beam; and the elongated ridge cap being mounted along the ridge beam, opposite the planar base.

3. The improved arched cabin as claimed in claim 1 comprising:

each of the plurality of roofing boards comprising a heat-insulating panel and a weather-proof panel;

the weather-proof panel for each of the plurality of roofing boards being mounted to the at least two corresponding proximal beams; and the heat-insulating panel being connected in between the at least two corresponding proximal beams and the weather-proof panel.

4. The improved arched cabin as claimed in claim 1 comprising:

the first roofing structure and the second roofing structure each comprising a plurality of internal heat-insulating panels;

the plurality of internal heat-insulating panels being distributed adjacent and across the plurality of arched beams, opposite the plurality of roofing boards; and each of the plurality of internal heat-insulating panels being mounted to the at least two corresponding proximal beams from the plurality of arched beams.

5. The improved arched cabin as claimed in claim 1 comprising:

the apex fastener comprising a male portion and a female portion;

the male portion being connected adjacent to the ridge beam;

the female portion being mechanically integrated into the first end of the tubular beam body; and the male portion being mechanically engaged into the female portion.

6. The improved arched cabin as claimed in claim 1 comprising:

the base fastener comprising a male portion and a female portion;

the male portion being connected adjacent and normal to the planar base;

the female portion being mechanically integrated into the second end of the tubular beam body; and the male portion being mechanically engaged into the female portion.

7. The improved arched cabin as claimed in claim 1 comprising:

a front sidewall;

a rear sidewall;

a building entrance;

the front sidewall being positioned adjacent and perpendicular to the planar base;

the front sidewall being perimetrically connected to the planar base, the first roofing structure, and the second roofing structure;

the rear sidewall being positioned parallel and opposite the front sidewall, across the planar base;

the rear sidewall being perimetrically connected to the planar base, the first roofing structure, and the second roofing structure; and the building entrance being mechanically integrated into the front sidewall.

8. An improved arched cabin comprising:

a first roofing structure;

a second roofing structure;

a planar base;

a ridge beam;

the first roofing structure and the second roofing structure each comprising a plurality of arched beams and a plurality of roofing boards;

the ridge beam being positioned parallel to the planar base;

the ridge beam being positioned offset from the planar base;

the first roofing structure being positioned adjacent to the ridge beam;

the second roofing structure being positioned adjacent to the ridge beam, opposite to the first roofing structure;

the plurality of arched beams being distributed along the ridge beam;

each of the plurality of arched beams being connected in between the ridge beam and the planar base;

a concave portion for each of the plurality of arched beams being oriented towards the planar base;

the plurality of roofing boards being distributed across the plurality of arched beams, opposite the planar base;

each of the plurality of roofing boards being mounted to an at least two corresponding proximal beams from the plurality of arched beams;

each of the plurality of arched beams comprising a tubular beam body, an apex fastener, and a base fastener;

a first end of the tubular beam body being laterally fixed the ridge beam by the apex fastener;

a second end of the tubular beam body being peripherally fixed to the planar base by the base fastener;

a cross-section of the tubular beam body comprising a U-shaped portion and an arched portion;

the arched portion being connected in between a first leg of the U-shaped portion and a second leg of the U-shaped portion;

the arched portion comprising a convex surface and a concave surface;

the convex surface being oriented towards an interconnecting leg of the U-shaped portion;

the concave surface being oriented towards the planar base;

an elongated ridge cap;

the elongated ridge cap being positioned parallel and adjacent to the ridge beam; and the elongated ridge cap being mounted along the ridge beam, opposite the planar base.

9. The improved arched cabin as claimed in claim 8 comprising:

each of the plurality of roofing boards comprising a heat-insulating panel and a weather-proof panel;

the weather-proof panel for each of the plurality of roofing boards being mounted to the at least two corresponding proximal beams; and the heat-insulating panel being connected in between the at least two corresponding proximal beams and the weather-proof panel.

10. The improved arched cabin as claimed in claim 8 comprising:

the first roofing structure and the second roofing structure each comprising a plurality of internal heat-insulating panels;

the plurality of internal heat-insulating panels being distributed adjacent and across the plurality of arched beams, opposite the plurality of roofing boards; and each of the plurality of internal heat-insulating panels being mounted to the at least two corresponding proximal beams from the plurality of arched beams.

11. The improved arched cabin as claimed in claim 8 comprising:

the apex fastener comprising a male portion and a female portion;

the male portion being connected adjacent to the ridge beam;

the female portion being mechanically integrated into the first end of the tubular beam body; and the male portion being mechanically engaged into the female portion.

12. The improved arched cabin as claimed in claim 8 comprising:

the base fastener comprising a male portion and a female portion;

the male portion being connected adjacent and normal to the planar base;

the female portion being mechanically integrated into the second end of the tubular beam body; and the male portion being mechanically engaged into the female portion.

13. The improved arched cabin as claimed in claim 8 comprising:

a front sidewall;

a rear sidewall;

a building entrance;

the front sidewall being positioned adjacent and perpendicular to the planar base;

the front sidewall being perimetrically connected to the planar base, the first roofing structure, and the second roofing structure;

the rear sidewall being positioned parallel and opposite the front sidewall, across the planar base;

the rear sidewall being perimetrically connected to the planar base, the first roofing structure, and the second roofing structure; and the building entrance being mechanically integrated into the front sidewall.

* * * * *